US009388649B2

(12) United States Patent
Looijen

(10) Patent No.: US 9,388,649 B2
(45) Date of Patent: Jul. 12, 2016

(54) OFFSHORE DRILLING INSTALLATION AND METHOD FOR OFFSHORE DRILLING

(71) Applicant: Fugro Engineers B.V., Leidschendam (NL)

(72) Inventor: Peter Looijen, Leidschendam (NL)

(73) Assignee: FUGRO ENGINEERS B.V., Leidschendam (NL)

( * ) Notice: Subject to any disclaimer, the term of this patent is extended or adjusted under 35 U.S.C. 154(b) by 0 days.

(21) Appl. No.: 14/554,867

(22) Filed: Nov. 26, 2014

(65) Prior Publication Data

US 2015/0315860 A1 Nov. 5, 2015

(30) Foreign Application Priority Data

Apr. 30, 2014 (NL) ..... 2012723

(51) Int. Cl.

| | |
|---|---|
| ***E21B 19/18*** | (2006.01) |
| ***E21B 17/01*** | (2006.01) |
| ***E21B 19/00*** | (2006.01) |
| ***B63B 35/44*** | (2006.01) |
| ***E21B 7/12*** | (2006.01) |
| ***E21B 7/128*** | (2006.01) |

(52) U.S. Cl.

CPC ..... *E21B 19/18* (2013.01); *B63B 35/4413* (2013.01); *E21B 7/122* (2013.01); *E21B 7/128* (2013.01); *E21B 17/01* (2013.01); *E21B 19/006* (2013.01)

(58) Field of Classification Search

CPC ..... E21B 19/18; E21B 17/01; E21B 19/006; E21B 35/4413; E21B 7/122; E21B 7/124; E21B 7/128; E21B 7/136; E21B 25/00

USPC ..... 175/5, 6, 7, 207, 92, 103, 122, 162, 175/202, 203, 321; 166/358, 71, 78.1

See application file for complete search history.

(56) References Cited

U.S. PATENT DOCUMENTS

| | | | | |
|---|---|---|---|---|
| 3,533,478 | A * | 10/1970 | Tissier | 173/37 |
| 3,593,808 | A * | 7/1971 | Nelson | 175/6 |
| 4,176,722 | A * | 12/1979 | Wetmore et al. | 175/7 |
| 6,325,158 | B1 * | 12/2001 | Rangnes et al. | 175/5 |
| 7,380,614 | B1 * | 6/2008 | Williamson et al. | 175/6 |
| 8,757,289 | B2 * | 6/2014 | Bauer et al. | 175/6 |

FOREIGN PATENT DOCUMENTS

| | | | | |
|---|---|---|---|---|
| GB | 2470763 | | 12/2010 | |
| WO | 02/36931 | | 5/2002 | |
| WO | 2009/157762 | | 12/2009 | |
| WO | WO 2009157762 | A1 * | 12/2009 | E21B 7/124 |

* cited by examiner

*Primary Examiner* — James G Sayre

(74) *Attorney, Agent, or Firm* — Peacock Myers, P.C.; Jeffrey D. Myers

(57) ABSTRACT

Offshore drilling installation comprising a platform selected from the group comprising a vessel, a pontoon, a jack-up, and further comprising a drill string drivingly connected with said platform and optionally provided with a heave motion compensator, wherein at its lower end the drill string is pro-vided with a drill bit, and wherein a seabed template suspended with lift wires from the platform is placed on a seabed, and wherein clamping means mounted in the seabed template are provided for fixing the drill string relative to the seabed template, which clamping means are embodied as a chuck which is arranged for clamping the drill string whilst enabling the drill string's rotation.

15 Claims, 4 Drawing Sheets

OFFSHORE DRILLING INSTALLATION AND METHOD FOR OFFSHORE DRILLING

CROSS-REFERENCE TO RELATED APPLICATIONS

This application claims priority to and the benefit of the filing of Netherlands Patent Application No. 2012723, filed on Apr. 30, 2014, and the specification and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to offshore drilling installations and methods.

2. Description of Related Art:

A known method and a known offshore drilling installation are known from WO02/36931 and can be illustrated with reference to FIG. 1. As opposed to subsea drilling as known from U.S. Pat. No. 3,741,320, offshore open hole drilling is normally done using surface mounted drilling equipment on a platform, like a (floating) vessel 1 as shown in FIG. 1, or on a pontoon or jack-up (fixed to the seabed via legs).

The drilling equipment of FIG. 1 comprises: means to assemble (make) and disassemble (break) the drill string; a motor 2 to rotate the drill string 7; a winch 3 to lower, lift and feed the drill string 7; and, in case of a floating vessel, a heave motion compensator 4.

In this prior art installation control of the weight on bit (WOB) and the rate of penetration (ROP) of the drill bit 5 are controlled from the platform, with guidance from bit guide 16. The drill string 7 is driven continuously or discontinuously until it reaches target depth. A typical application is for geotechnical site investigation. In offshore drilling for geotechnical site investigation down hole tools are used to determine various parameters of the soil, like strength, type, etc. These tools require a stationary drill bit 5 in relation to the seabed 27 in order to collect good quality data. The surface mounted means to compensate for heave motion 4 are in this respect not ideal and have errors that result in displacement or force variation at the drill bit 5. In normal operations these variations are directly transferred to the drill bit 5 creating soil disturbances under the drill bit 5. Once the drill bit 5 is advanced to a particular depth of interest the rotation is stopped and the drill string 7 is fixed to the seabed template 26 using a stationary clamp 15. During sampling the errors of the heave motion compensator 4 will be transferred into the seabed template 26 and from the template into the seabed 27. Although the template is sized in weight and bearing area that residual motions are reduced to an acceptable level, the industry is still looking for improvement.

The clamping means mounted in the seabed template according to WO02/36931 are embodied as a chuck to clamp the drill string whilst still enabling the drill string's rotation. Various chuck designs exist that allow free rotation while vertically constraining the pipe. This enables controlling the drill pipe at the lower end (at seabed), which has a major advantage over control at the top as displacement errors and force variations errors at the drill bit are much less resulting in a better controlled drilling process. Other prior art offshore drilling installations with surface mounted drilling equipment only clamp the drill string when sampling is done and the pipe is not rotating.

BRIEF SUMMARY OF THE INVENTION

The invention relates to an offshore drilling installation comprising a platform selected from the group comprising a vessel, a pontoon, a jack-up, and further comprising a drill string drivingly connected with said platform and optionally provided with a heave motion compensator, wherein at its lower end the drill string is provided with a drill bit, and wherein a seabed template suspendable from the platform is placable on a seabed, and wherein clamping means mounted in the seabed template are provided for fixing the drill string relative to the seabed template, wherein the clamping means are embodied as a chuck which is arranged for clamping the drill string whilst enabling the drill string's rotation. The invention also relates to a method for offshore drilling making use of such an offshore drilling installation.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
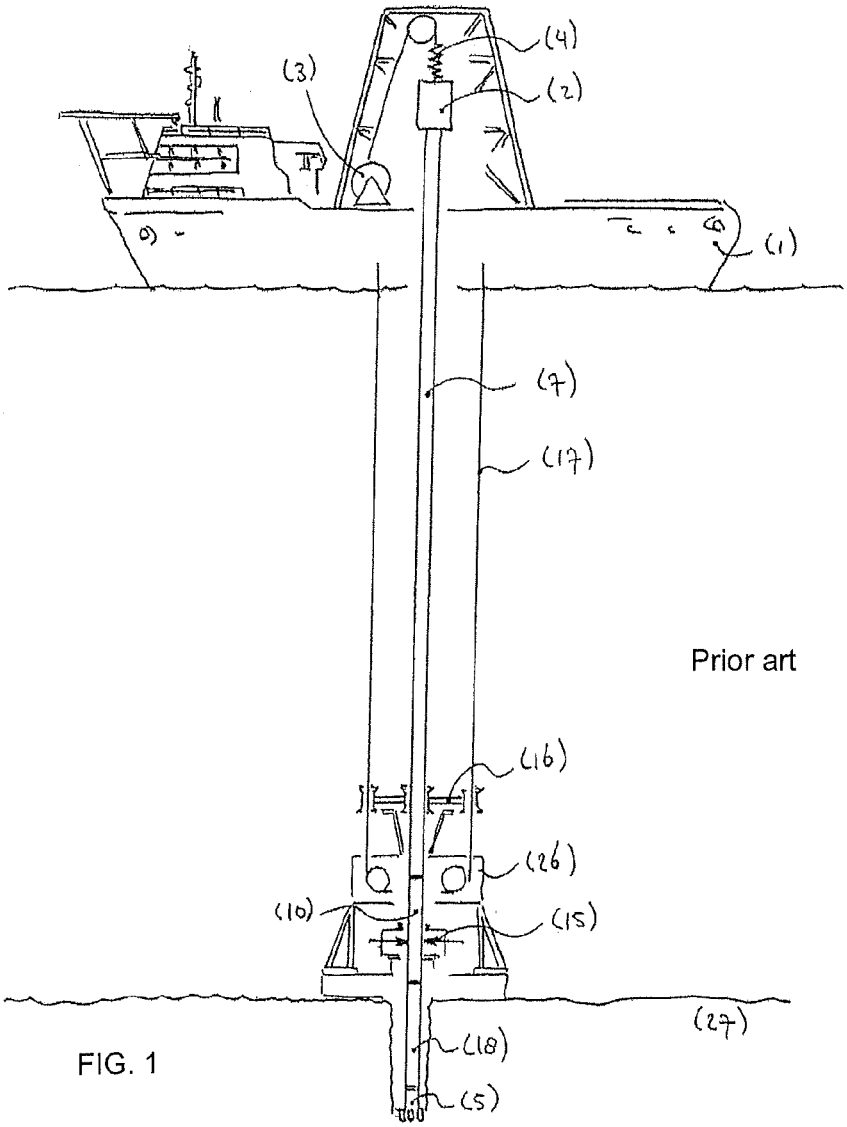
FIG. 1 shows an offshore drilling installation according to the prior art.

The chuck used in the offshore drilling installation of the invention comprises a housing that is supported by the seabed template, wherein in said housing wedge-shaped clamping means are provided for clamping the drill string, which wedge-shaped clamping means have a rotation enabling coupling with said housing. Further beneficial features are provided in the dependent claims.

It is for instance beneficial to provide the chuck with vertical drive means. In that case more weight on bit can be generated due to the downward thrust available in the drive means compared to surface control, as the drill string will in the latter case be more prone to buckling due to its relatively long unsupported length in the water column. This aspect of the invention brings about the possibility to drill in hard formations: at relative shallow water where insufficient weight can be added due to the limited length available; at the very top layer of the ground as the drive means can generate the required downward force when the drill string is radially supported by the chuck; and in general when encountering hard layers drilling can be done using a drill string with less weight as the drive means provide the downward thrust without having to rely on the weight of the drill string itself.

Suitably the chuck is provided with a hydraulic cylinder or cylinders connecting the chuck with the seabed template. Hydraulic cylinders are well known and effective drive means which can advantageously be used to drive the chuck in the vertical direction.

In another preferred embodiment the clamping means are embodied with a first chuck and a second chuck, which are both arranged for clamping the drill string whilst enabling the drill string's rotation. The drive means of the first chuck and the second chuck are preferably independently operable. By arranging that the first chuck and the second chuck are independently drivable and are driven repeatedly one after the other it is possible to push the drill string downwards or pull the drill string upwards. A continuous feed (rate of penetration) can then be generated by using these two chucks both having their own vertical drive means. By using the chucks in a repetitive motion, one pushes the string down while the other is re-stroking to take over the downward motion once the other chuck reaches its end of stroke. And so further and so forth until the drill bit reaches the target depth. A stationary clamp may be added as a back-up to continue the work in 'normal' mode in case the drive means of the chucks fail. The two chucks can also be used in tandem to double the available downward thrust.

One further aspect of the offshore drilling installation of the invention is that the chuck or chucks can accommodate drill string diameters ranging at least from 125 to 250 mm. This large clamping range enables the use of standard drill pipe and drill collars. The chuck can thus clamp on a large variety of diameters encountered in a drill string like a conventional drill pipe body, a tool joint or drill collar.

The chuck or chucks can preferably be expanded to enable passing of a drill bit including the drill bit at its lower end and any tool joint or drill collar above the drill bit. If the bit can pass the chuck the drill string can be handled independently from the handling of the seabed template. This makes handling at the platform deck less complex and allows relative easy reentry of the drilled hole. Re-entry is sometime required to replace or inspect the drill bit or to abandon the hole due to poor weather conditions such that drilling cannot commence or continue and the drill string has to be pulled back to deck. The seabed template than can remain at the seabed in the same position above the hole and if the drill bit is replaced when the weather conditions are favorable again, the drill string can be lowered into the drilled hole and continue drilling at the last reached elevation.

Other beneficial features that are independently from each other applicable and that characterize the chuck or chucks preferably used in the offshore drilling installation of the invention are: that the wedge-shaped clamping means are fixed to an inner tube which is connected through bearings with the housing so as to arrange that the inner tube and clamping means can jointly rotate within the housing yet are unmovable with reference to the housing in vertical direction; that the wedge-shaped clamping means are slidably connected with a wedge-shaped backing ring, wherein their contacting surfaces are oblique with reference to the longitudinal direction of the drill string and tapering upwards when the wedge-shaped clamping means engage said drill string; that the wedge-shaped backing ring is supported through bearings by a supporting ring which is drivingly connected with the housing; and that the housing is provided with actuator means for driving the supporting ring that supports the wedge-shaped backing ring.

The invention will hereinafter be further elucidated with reference to the drawing of an exemplary embodiment of an apparatus according to the invention that is not limiting as to the appended claims.

Figure 2:
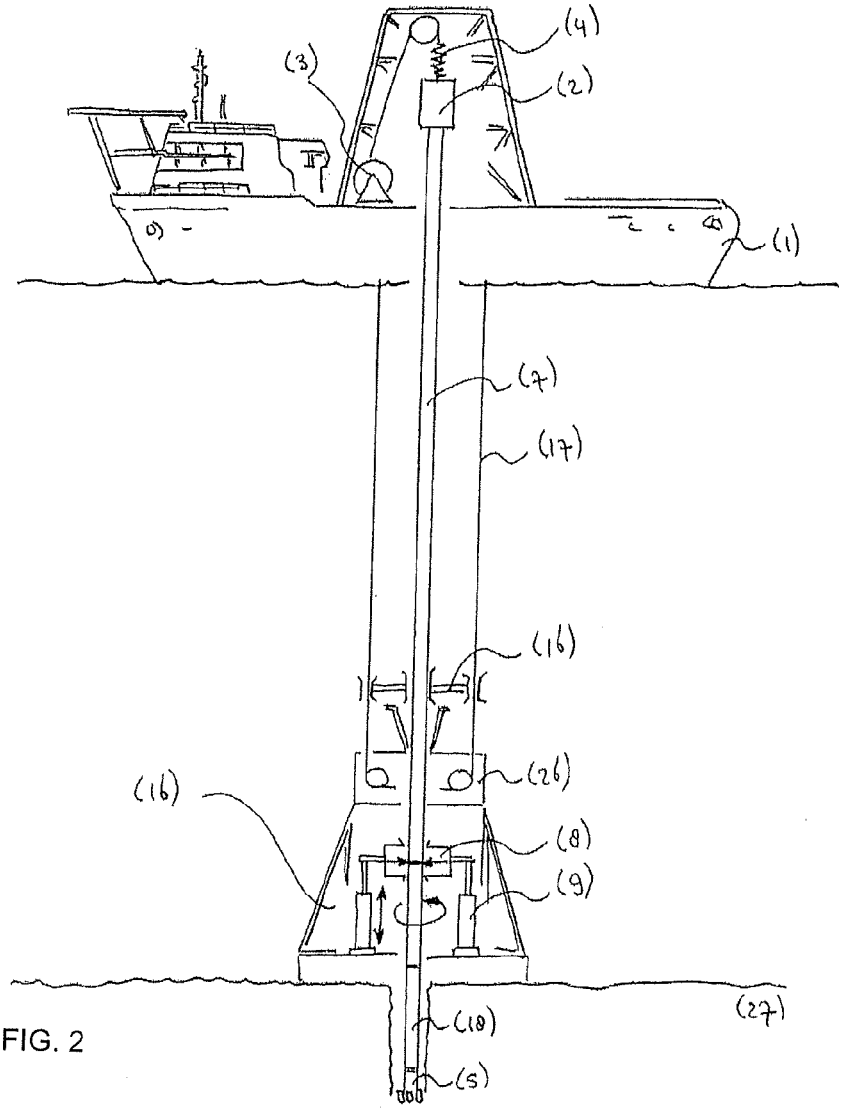
FIG. 2 shows a first embodiment of an offshore drilling installation according to the invention in which a single chuck is applied.

Making reference now to FIG. 2 offshore drilling installation according to the invention is shown comprising a vessel as a platform 1 (alternatively it could be a pontoon or a jack-up), and further comprising a drill string 7 drivingly connected with said platform 1 and provided with a heave motion compensator 4, wherein at its lower end the drill string 7 is provided with a drill bit 5, and wherein a seabed template 26 suspended with lift wires 17 from the platform 1 is placed on a seabed 27, and wherein clamping means embodied as a chuck 8 are mounted in the seabed template 26 for fixing the drill string 7 relative to the seabed template 26. The chuck 8 is arranged for clamping the drill string 7 whilst enabling still the drill string's rotation.

Figure 3:
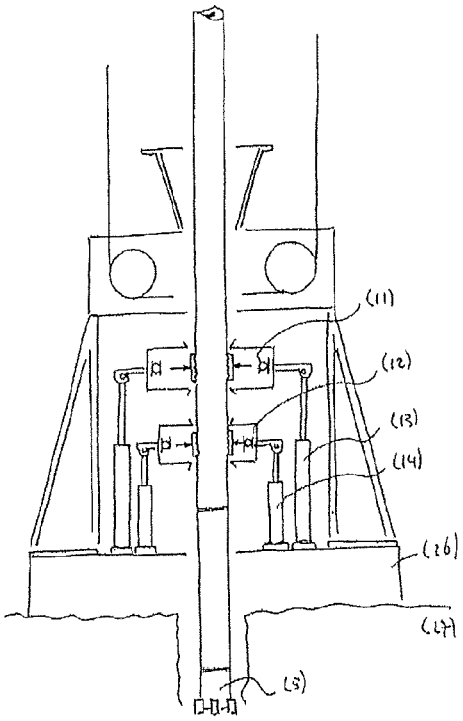
FIG. 3 shows a detail of a second embodiment of an offshore drilling installation according to the invention in which two chucks are applied.

FIG. 3 shows an alternative arrangement in which the clamping means are embodied with a first chuck 11 and a second chuck 12, which are both arranged for clamping the drill string whilst enabling the drill string's rotation. Preferably in this embodiment the first chuck 11 and the second chuck 12 are independently operable with independent vertical drive means 13 and 14 to arrange that that the first chuck 11 and the second chuck 12 can be driven repeatedly one after the other to push the drill string downwards or pull the drill string upwards. It is also then possible to arrange that the first chuck 11 and the second chuck 12 are driven in tandem. Preferably the drive means for the chucks 11, 12 are embodied as hydraulic cylinder or cylinders 13, 14 connecting the chucks 11, 12 with the sea-bed template 26.

One further preferred feature is that the chuck 8 or chucks 11, 12 can accommodate drill string diameters up to 125 mm and that the chuck 8 or chucks 11, 12 can be expanded to enable passing of a drill string 7 including the drill bit 5 at its lower end and any tool joint or drill collar above the drill bit 5.

Figure 4:
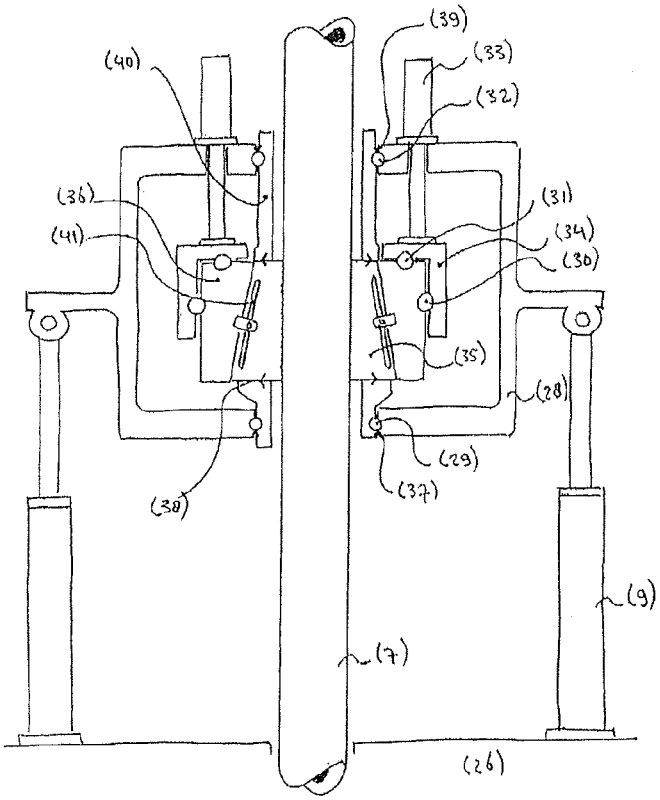
FIG. 4 shows a chuck as applied in an offshore drilling installation according to the invention.

Making now reference to FIG. 4 relating essentially to the chuck, it is shown that the chuck comprises a housing 28 that is supported by the seabed template 26, and that in said housing 28 wedge-shaped clamping means 35 (preferably clamping blocks) are provided for clamping the drill string 7, which wedge-shaped clamping means 35 have a rotation enabling coupling with said housing 28. The wedge-shaped clamping means 35 are fixed to an inner tube 40 which is connected through bearings 29, 32 with the housing 28 providing the rotation enabling coupling with said housing 28 so as to arrange that the inner tube 40 and the clamping means 35 can jointly rotate within the housing 28, yet are unmovable with reference to the housing 28 in vertical direction.

FIG. 4 further shows that the wedge-shaped clamping means 35 are slidably connected with a wedge-shaped backing ring 36, wherein their contacting surfaces are oblique with reference to the longitudinal direction of the drill string 7 and tapering upwards when the wedge-shaped clamping means 35 engage said drill string 7. The wedge shaped backing ring 36 that is provided in the supporting ring 34 and supported by said supporting ring 34 is suspended in bearings 30, 31 to allow that the wedge shaped 36 ring can rotate freely although it is vertically constraint by the bearings 30, 31. The supporting ring 34 is drivingly connected with the housing 28. For the latter purpose the housing 28 is provided with actuator means 33 for driving the supporting ring 34 that supports the wedge-shaped backing ring 36.

In operation the actuators 33, for instance a set of hydraulic rams mounted on the housing 28, are used to activate (move up or down) the supporting ring 34. The clamping means 35 inside the wedged shaped ring 36 can move radially in consequence thereof as explained hereafter. At the same time the clamping means 35 are vertically constraint in the inner tube 40 that is vertically fixed to the outer housing 28 but—as mentioned above—the clamping means 35 can rotate freely inside the housing 28 due to the bearings 29, 32.

The clamping means 35 are connected with the wedge shaped ring 36 via a sliding mechanism 41. This causes the clamping means 35 to move outwardly when the wedge shaped backing ring 36 is moving up. Conversely by pushing down the supporting ring 34, the wedge-shaped backing ring 36 will also go down forcing the clamping means 35 to move inwardly so as to clamp on the drill string 7.

Seals 38, 39, 37 are provided in the chuck to seal the housing 28 and allow for pressure compensation and to keep the moving parts lubricated and free from dirt and debris. When the clamping means 35 clamp the drill string, the drill string 7 is vertically constraint within the chuck but can still freely rotate. The housing 28 is connected to the vertical drive means, in particular hydraulic cylinders 9 to drive the drill string 7 down or up also when the drill string 7 is not rotated.

Although the invention has been discussed in the foregoing with reference to an exemplary embodiment of the offshore drilling installation and method for offshore drilling according to the invention, the invention is not restricted to the discussed particular embodiments which can be varied in many ways without departing from the gist of the invention. The discussed exemplary embodiments shall therefore not be used to construe the appended claims strictly in accordance therewith. On the contrary the embodiments are merely intended to explain the wording of the appended claims without intent to limit the claims to the embodiments. The scope of protection of the invention shall therefore be construed in accordance with the appended claims only, wherein a possible ambiguity in the wording of the claims shall be resolved using the embodiments.

What is claimed is:

1. Offshore drilling installation comprising a platform selected from the group consisting of a vessel, a pontoon, and a jack-up, and further comprising a drill string drivingly connected with said platform, wherein at its lower end the drill string is provided with a drill bit, and wherein a seabed template suspendable from the platform is placeable on a seabed, and wherein a clamp mounted in the seabed template is provided for fixing the drill string relative to the seabed template, wherein the clamp is embodied as a chuck which is arranged for clamping the drill string whilst enabling the drill string's rotation, and wherein the chuck comprises a housing that is supported by the seabed template, and wherein in said housing a wedge-shaped clamp is provided for clamping the drill string, which wedge-shaped clamp has a rotation enabling coupling with said housing, wherein the wedge-shaped clamp is fixed to an inner tube which is connected through bearings with the housing so as to arrange that the inner tube and wedge-shaped clamp can jointly rotate within the housing vet are unmovable with reference to the housing in a vertical direction.

2. Offshore drilling installation according to claim 1, wherein the clamp mounted in the seabed template is embodied with a first chuck and a second chuck, which are both arranged for clamping the drill string whilst enabling the drill string's rotation.

3. Offshore drilling installation according to claim 2, wherein the first chuck and the second chuck are independently operable.

4. Offshore drilling installation according to claim 1, wherein the chuck can accommodate drill string diameters ranging at least from 125 to 250mm.

5. Offshore drilling installation according to claim 1, wherein the chuck can be expanded to enable passing of a drill string including the drill bit at its lower end and any tool joint or drill collar above the drill bit.

6. Offshore drilling installation according to claim 1, wherein the chuck is provided with vertical drive means.

7. Offshore drilling installation according to claim 1, wherein the chuck is provided with a hydraulic cylinder or cylinders connecting the chuck or chucks with the seabed template.

8. Offshore drilling installation according to claim 1, wherein the wedge-shaped clamp is slidably connected with a wedge-shaped backing ring, wherein their contacting surfaces are oblique with reference to the longitudinal direction of the drill string and tapering upwards when the wedge-shaped clamp engages said drill string.

9. Offshore drilling installation according to claim 8, wherein the wedge-shaped backing ring is supported through bearings by a supporting ring which is drivingly connected with the housing.

10. Offshore drilling installation according to claim 9, wherein the housing is provided with actuator means for driving the supporting ring that supports the wedge-shaped backing ring.

11. Offshore drilling installation according to claim 1, wherein said clamp mounted in the seabed template comprises clamping blocks.

12. Offshore drilling installation according to claim 1, wherein said platform is provided with a heave motion compensator.

13. Method for offshore drilling comprising the steps of:

selecting a platform from the group consisting of a vessel, a pontoon, and a jack-up;

providing said platform with a drill string;

providing the platform with a drive for the drill string;

providing the drill string at its lower end with a drill bit;

suspending from the platform a seabed template and placing said seabed template on a seabed;

providing a clamp in the seabed template for fixing the drill string relative to the seabed template;

arranging that the clamp is embodied with a first chuck and a second chuck, which are both arranged for clamping the drill string whilst enabling the drill string's rotation; and providing the chucks with vertical drive means and arranging that the first chuck and the second chuck are independently drivable and are driven repeatedly one after the other to push the drill string downwards or pull the drill string upwards.

14. Method for offshore drilling according to claim 13, wherein by arranging that the first chuck and the second chuck are driven in tandem.

15. Method for offshore drilling according to claim 13, additionally comprising the step of providing the platform with a heave motion compensator.

* * * * *